US010950947B2

(12) United States Patent
Chen et al.

(10) Patent No.: US 10,950,947 B2
(45) Date of Patent: Mar. 16, 2021

(54) ANTENNA FEED ELEMENTS WITH CONSTANT INVERTED PHASE

(71) Applicant: CommScope Technologies LLC, Hickory, NC (US)

(72) Inventors: Changfu Chen, Suzhou (CN); Hangsheng Wen, Suzhou (CN); YueMin Li, Suzhou (CN)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 209 days.

(21) Appl. No.: 16/304,961

(22) PCT Filed: May 31, 2017

(86) PCT No.: PCT/US2017/035088

§ 371 (c)(1),
(2) Date: Nov. 27, 2018

(87) PCT Pub. No.: WO2017/222757

PCT Pub. Date: Dec. 28, 2017

(65) Prior Publication Data

US 2020/0343642 A1 Oct. 29, 2020

(30) Foreign Application Priority Data

Jun. 23, 2016 (CN) ..... 201610461754.6

(51) Int. Cl.
*H01Q 9/28* (2006.01)
*H01Q 11/14* (2006.01)
*H01Q 1/24* (2006.01)

(52) U.S. Cl.
CPC ..... *H01Q 9/28* (2013.01); *H01Q 1/24* (2013.01); *H01Q 1/246* (2013.01); *H01Q 11/14* (2013.01)

(58) Field of Classification Search
CPC ..... H01Q 9/28; H01Q 1/246; H01Q 11/14; H01Q 1/24
(Continued)

(56) References Cited

U.S. PATENT DOCUMENTS 3,031,668 A * 4/1962 Bryson ..... H01Q 21/10 343/790
4,400,702 A * 8/1983 Tanaka ..... H01Q 9/16 343/790
(Continued)

FOREIGN PATENT DOCUMENTS

CN 2074060 3/1991
CN 2266802 11/1997
(Continued)

OTHER PUBLICATIONS

International Search Report and Written Opinion of the International Searching Authority, International Application No. PCT/US2017/035088, dated Aug. 31, 2017, 10 pp.
(Continued)

*Primary Examiner* — Hai V Tran
(74) *Attorney, Agent, or Firm* — Myers Bigel, P.A.

(57) ABSTRACT

A dipole antenna includes a feed line, first and second microstrip probes, a first signal transmission line coupled to the feed line and to the first microstrip probe, and a second signal transmission line coupled to the feed line and to the second microstrip probe. The first signal transmission line includes a first transmission line including a first signal conductor and a first ground conductor and a second transmission line including a second signal conductor and a second ground conductor. The first signal conductor is electrically coupled to the feed line and to the second ground
(Continued)

conductor and the second signal conductor is electrically coupled to the first microstrip probe and the first ground conductor.

13 Claims, 9 Drawing Sheets

(58) Field of Classification Search
USPC ..... 343/702
See application file for complete search history.

(56) References Cited

U.S. PATENT DOCUMENTS 4,652,861 A * 3/1987 Domes ..... E02F 9/245 324/67
4,774,481 A * 9/1988 Edwards ..... H01P 5/16 333/127
4,788,515 A 11/1988 Wong et al.
4,797,643 A * 1/1989 Wong ..... H01P 5/183 333/115
4,800,393 A 1/1989 Edward et al.
4,937,588 A * 6/1990 Austin ..... H01Q 9/08 343/790
5,896,107 A 4/1999 Huynh
6,483,471 B1 11/2002 Petros
6,657,601 B2 12/2003 McLean
8,629,807 B2 * 1/2014 Wood ..... H01Q 3/2694 342/375
9,276,310 B1 * 3/2016 Apel ..... H01Q 1/362
2002/0186171 A1 12/2002 Petros
2003/0117333 A1 6/2003 McLean
2005/0237260 A1 10/2005 Bancroft
2010/0013731 A1 1/2010 Kittel
2012/0007788 A1 1/2012 Hung
2012/0164942 A1 6/2012 Mohammadian
2015/0311579 A1 * 10/2015 Irci ..... H01Q 1/243 343/702
2015/0373837 A1 * 12/2015 Frye ..... H05K 1/0228 333/4

FOREIGN PATENT DOCUMENTS

CN 1965442 5/2007
CN 2916955 6/2007
CN 103872434 6/2014

OTHER PUBLICATIONS

Orban et al., "The Basics of Patch Antennas, Updated", retrieved from http://orbanmicrowave.com/wp-content/uploads/2014/12/Orban-Patch-Antennas-2009-rev.pdf, Sep. 29, 2009, 20 pp.
Wikipedia, the free encyclopedia, "Dipole antenna", retrieved May 1, 2016 from https://en.wikipedia.org/wiki/Dipole_antenna, 19 pp.
English translation of the First Office Action corresponding to Chinese Patent Application No. 201610461754.6 (19 pages) (dated Aug. 3, 2020).

* cited by examiner

ANTENNA FEED ELEMENTS WITH CONSTANT INVERTED PHASE

CROSS-REFERENCE TO RELATED APPLICATIONS

The present application is a 35 U.S.C. § 371 national stage application of PCT Application No. PCT/US2017/035088, filed on May 31, 2017, which itself claims priority to Chinese Patent Application No. 201610461754.6, filed Jun. 23, 2016, the entire content of both of which are incorporated herein by reference as if set forth in its entirety their entireties. The above-referenced PCT Application was published in the English language as International Publication No. WO 2017/222757 A1 on Dec. 28, 2017.

BACKGROUND

Cellular base stations use sectored antennas to transmit and receive radio signals in a coverage area served by the base station. It is generally desirable to have a high degree of isolation between the signals received and transmitted by the antennas, and, accordingly, it is desirable to have a high degree of isolation between antennas in the base station.

Increased isolation between antenna signals typically results in less signal interference between the two antennas and improved signal strength. Isolation between antennas may be achieved by physically separating the antennas, through the use of interference cancellation techniques and/or through antenna design.

A cellular base station antenna 10 is generally illustrated in FIG. 1, which shows a lower portion of an antenna housing that encloses the radiating elements of the antenna. The antenna 10 includes three signal inputs 12 for various operational frequencies.

Antennas for wireless communications for certain frequencies of operation may be implemented as patch dipole antennas that use microstrip transmission line segments to transfer radio frequency (RF) signals to/from the radiating elements of the antenna. Increased isolation of microstrip antennas can be achieved by adding a phase balance line to one of the antenna probes. For example, FIG. 2 illustrates a conventional microstrip antenna 20 including a feed line 22 and first and second radiating probes 24, 26. A phase balance line 28 is added to the second radiating probe 26. The phase balance line 28 is provided to cause the signal radiated by the second radiating probe 26 to have a phase that is about 180 degrees out of phase with the signal radiated by the first radiating probe 24.

The length of the phase balance line 28 is based on the center frequency of operation of the antenna 20. However, because physical length of the phase balance line 28 is dependent upon frequency, the phase balance line 28 cannot provide an exact 180 degree phase difference over the entire operational bandwidth of the antenna 20. It is therefore difficult to maintain a 180 degree phase difference between the signals radiated by the first and second radiating probes 24, 26. This may decrease the isolation between antennas, and may result in increased losses, greater interference, and/or lower battery life in mobile receivers that must use more processing power to differentiate the signals.

SUMMARY

A dipole antenna according to some embodiments includes a feed line, first and second microstrip probes, a first signal transmission line coupled to the feed line and to the first microstrip probe, and a second signal transmission line coupled to the feed line and to the second microstrip probe. The first signal transmission line includes a first transmission line including a first signal conductor and a first ground conductor and a second transmission line including a second signal conductor and a second ground conductor. The first signal conductor is electrically coupled to the feed line and to the second ground conductor and the second signal conductor is electrically coupled to the first microstrip probe and the first ground conductor.

The first transmission line may include a first coaxial cable including a first inner conductor corresponding to the first signal conductor and a first outer conductor corresponding to the first ground conductor.

The second transmission line may include a second coaxial cable including a second inner conductor corresponding to the second signal conductor and a second outer conductor corresponding to the second ground conductor. The first inner conductor may be electrically coupled to the second outer conductor, and the first outer conductor may be electrically coupled to the second inner conductor.

The second transmission line may include a microstrip transmission line including a microstrip conductor corresponding to the second signal conductor and a ground plane corresponding to the second ground conductor. The first inner conductor may be electrically coupled to the ground plane, and the first outer conductor may be electrically coupled to the microstrip conductor.

The first transmission line may include a first microstrip transmission line including a first microstrip conductor corresponding to the first signal conductor and a first ground plane corresponding to the first ground conductor, and the second transmission line may include a second microstrip transmission line including a second microstrip conductor corresponding to the second signal conductor and a second ground plane corresponding to the second ground conductor. The dipole antenna may further include a first balanced transmission line coupled to the first transmission line, the first balanced transmission line including a first signal line and a first ground line, a second balanced transmission line coupled to the second transmission line, the second balanced transmission line including a second signal line and a second ground line, and a crossover connection between the first balanced transmission line and the second balanced transmission line. The first signal line may be electrically coupled to the second ground line and the first ground line is electrically coupled to the second signal line.

The dipole antenna may further include a substrate, wherein the first signal line comprises a first conductive trace on a first surface of the substrate, the first ground line comprises a second conductive trace on a second surface of the substrate opposite the first signal line, and the first signal line and the first ground line have the same width in a direction transverse to a direction of signal propagation.

The second signal line may include a third conductive trace on the first surface of the substrate, the second ground line may include a fourth conductive trace on the second surface of the substrate opposite the first signal line, and the second signal line and the second ground line may have the same width.

The dipole antenna may further include a first conductive plug extending through the substrate and electrically coupling the first signal line and the second ground line, and a second conductive plug extending through the substrate and electrically coupling the second signal line and the first ground line.

The first ground plane may be wider in a direction transverse to a direction of signal propagation through the first signal transmission line than the first ground line, and the second ground plane may be wider in the direction transverse to current flow through the first signal transmission line than the second ground line.

The dipole antenna may further include a splitter including an input port and first and second output ports, wherein the feed line is connected to the input port, the first signal transmission line is connected to the first output port, and the second signal transmission line is connected to the second output port.

A crossover transmission line according to some embodiments includes an input port, an output port, a first transmission line including a first signal conductor and a first ground conductor, and a second transmission line including a second signal conductor and a second ground conductor. The first signal conductor is coupled to the input port and to the second ground conductor and the second signal conductor is coupled to the output port and the first ground conductor.

The first transmission line may include a first coaxial cable including a first inner conductor corresponding to the first signal conductor and a first outer conductor corresponding to the first ground conductor.

The second transmission line may include a second coaxial cable including a second inner conductor corresponding to the second signal conductor and a second outer conductor corresponding to the second ground conductor. The first inner conductor may be electrically coupled to the second outer conductor, and the first outer conductor may be electrically coupled to the second inner conductor.

The second transmission line may include a microstrip transmission line including a microstrip conductor corresponding to the second signal conductor and a ground plane corresponding to the second ground conductor. The first inner conductor may be electrically coupled to the ground plane, and the first outer conductor may be electrically coupled to the microstrip conductor.

The first transmission line may include a first microstrip transmission line including a first microstrip conductor corresponding to the first signal conductor and a first ground plane corresponding to the first ground conductor and the second transmission line may include a second microstrip transmission line including a second microstrip conductor corresponding to the second signal conductor and a second ground plane corresponding to the second ground conductor. The crossover transmission line may further include a first balanced transmission line coupled to the first transmission line, the first balanced transmission line including a first signal line and a first ground line, a second balanced transmission line coupled to the second transmission line, the second balanced transmission line including a second signal line and a second ground line, and a crossover connection between the first balanced transmission line and the second balanced transmission line, wherein the first signal line is electrically coupled to the second ground line and the first ground line is electrically coupled to the second signal line.

The crossover transmission line may further include a substrate, the first signal line comprises a first conductive trace on a first surface of the substrate, the first ground line comprises a second conductive trace on a second surface of the substrate opposite the first signal line, and the first signal line and the first ground line have the same width.

The second signal line may include a third conductive trace on the first surface of the substrate. The second ground line may include a fourth conductive trace on the second surface of the substrate opposite the first signal line, and the second signal line and the second ground line may have the same width.

The crossover transmission line may further include a first conductive plug extending through the substrate and electrically coupling the first signal line and the second ground line, and a second conductive plug extending through the substrate and electrically coupling the second signal line and the first ground line.

The first ground plane may be wider in a direction transverse to a direction of signal propagation through the first signal transmission line than the first ground line, and the second ground plane may be wider in the direction transverse to current flow through the first signal transmission line than the second ground line.

A dipole antenna according to some embodiments includes a feed line, first and second microstrip probes, a first signal transmission line coupled to the feed line and to the first microstrip probe, and a second signal transmission line coupled to the feed line and to the second microstrip probe. The first signal transmission line includes a first transmission line including a first signal conductor and a first ground conductor, a second transmission line including a second signal conductor and a second ground conductor, and a crossover coupler connected between the first and second transmission lines, wherein the crossover coupler is configured to couple the first signal conductor to the second ground conductor and to couple the second signal conductor to the first ground conductor.

DETAILED DESCRIPTION OF EMBODIMENTS

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Some embodiments described herein provide feed elements for antennas that provide a constant 180 degree phase difference independent of frequency. Some embodiments are based on the realization that the ground conductor of an RF transmission line carries a signal that is exactly 180 degrees out of phase with the signal carried on the main signal carrier. For example, in the case of a coaxial cable transmission line including a center conductor and a cylindrical outer conductor, the outer conductor carries a signal that is exactly 180 degrees out of phase with the signal carried on the inner conductor.

Figure 1:
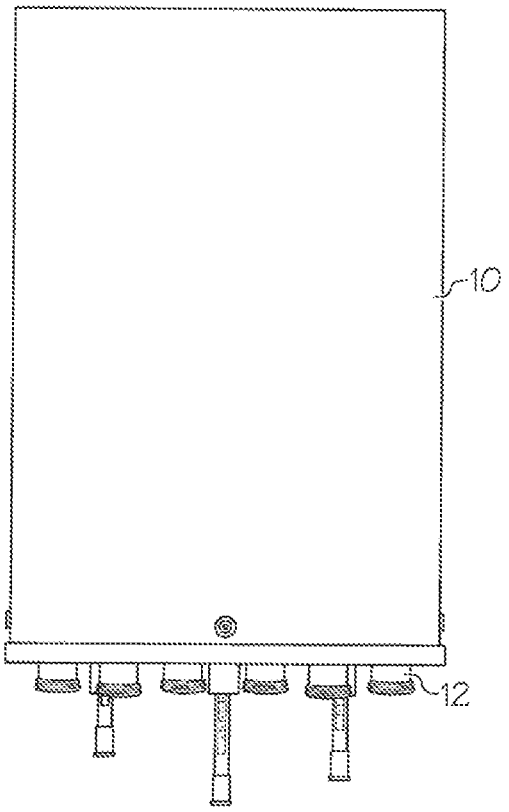
FIG. 1 illustrates a lower portion of an antenna housing that encloses the radiating elements of a base station antenna.
Figure 2:
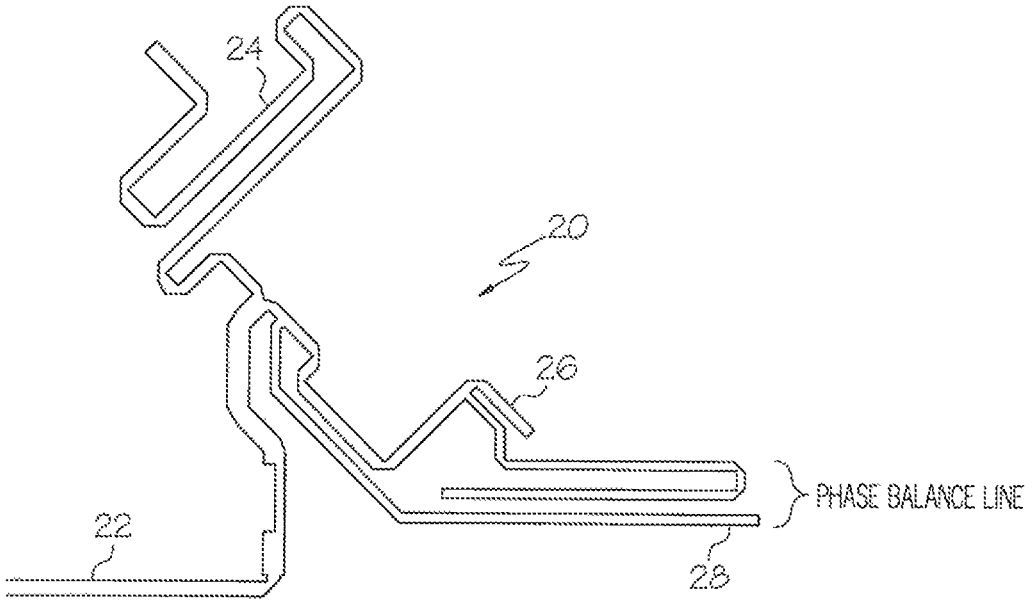
FIG. 2 is a simplified schematic drawing that illustrates a conventional microstrip antenna.
Figure 3:
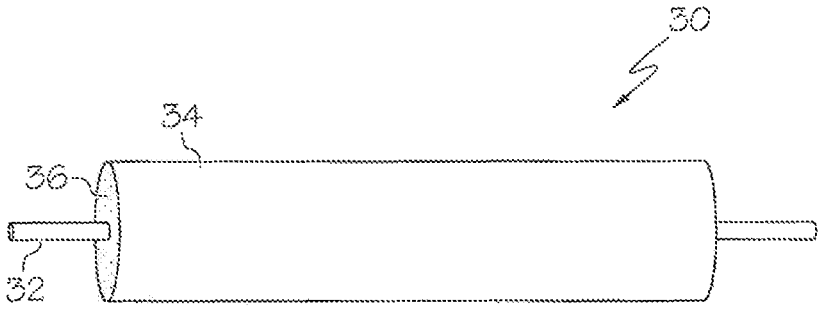
FIG. 3 is a simplified schematic drawing that illustrates a coaxial cable.
Figure 4:
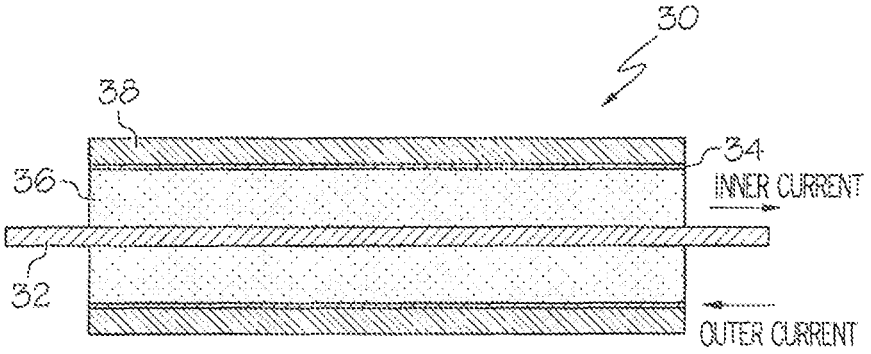
FIG. 4 is a cross sectional illustration of the coaxial cable of FIG. 3.

FIG. 3 is a simplified illustration of a coaxial cable 30, and FIG. 4 is a longitudinal cross sectional view of the coaxial cable 30. The coaxial cable 30 includes an inner conductor 32 and a cylindrical outer conductor 34 that are separated by a dielectric material 36. An Insulating jacket 38 surrounds the outer conductor 34. In FIG. 3, the coaxial cable 30 is shown without the insulating jacket 38 for clarity of illustration. A conventional coaxial cable 30 may have a characteristic impedance of 50 ohms or 75 ohms depending on the physical dimensions of the cable.

When a radio frequency signal is transmitted along a coaxial cable, the signals carried on the inner and outer conductors are exactly 180 degrees out of phase (anti-phase) at each point along the cable and at all frequencies. This means that a signal with exactly 180 degrees phase difference is available at all points on the coaxial cable. Similar effects can be observed in other types of transmission lines, such as microstrip transmission lines. Some embodiments utilize this property of RF transmission lines to feed a radiating probe of an antenna with a signal that is phase shifted by 180 degrees. According to some embodiments, this may be accomplished by connecting two coaxial cables such that their inner and outer conductors are crossed.

Figure 5:
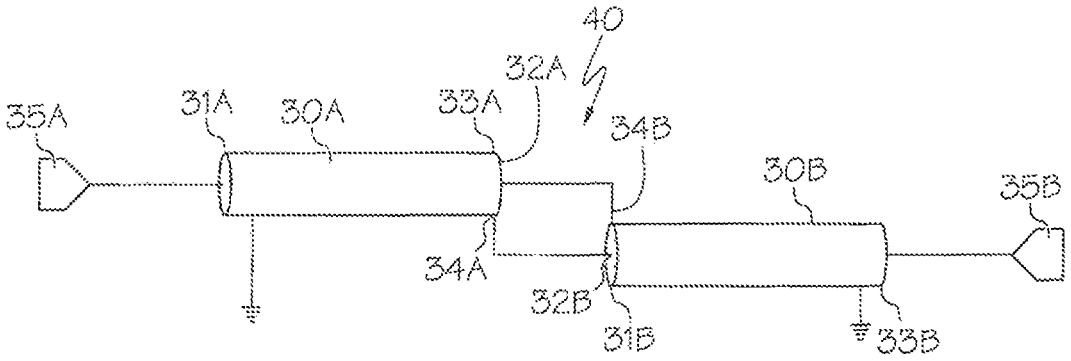
FIG. 5 is a simplified schematic circuit diagram illustrating an RF transmission line according to some embodiments.

Crossing conductors of first and second coaxial cables according to some embodiments is illustrated in FIG. 5, which is a simplified schematic circuit diagram illustrating an RF transmission line including an input port 35A, two coaxial cables 30A, 30B, and an output port 358. The input port 35A is connected at a first end 31A of the first coaxial cable 30A to the inner conductor 32A of the first coaxial cable 30A. The outer conductor 34A of the first coaxial cable 30A is grounded at the first end 31A of the first coaxial cable 30A.

The first coaxial cable 30A and the second coaxial cable 30B are joined together at the second end 33A of the first coaxial cable 30A and the first end 31B of the second coaxial cable 30B by a crossover connection 40. In particular, in the crossover connection 40, the inner conductor 32A of the first coaxial cable 30A is connected to the outer conductor 34B of the second coaxial cable 30B at the second end 33A of the first coaxial cable, and the outer conductor 34A of the first coaxial cable 30A is connected to the inner conductor 32B of the second coaxial cable 30B at the first end 31B of the second coaxial cable 30B.

The outer conductor 34B of the second coaxial cable 308 is grounded at the second end 33B of the second coaxial cable 308, and the inner conductor 32B of the second coaxial cable 30B is coupled to the output port 35B at the second end 33B of the second coaxial cable 30B. By virtue of this crossover connection 40, the signal provided at the output port 358 is approximately 180 degrees out of phase with the signal that would otherwise have been provided at the output port 35B absent the crossover connection 40, assuming a similar electrical length. The signal output at the output port 35B may, for example, be used to drive a radiating probe of a dipole antenna with a signal that is 180 degrees out of phase with the signal driving the other radiating probe of the dipole antenna.

Figure 6:
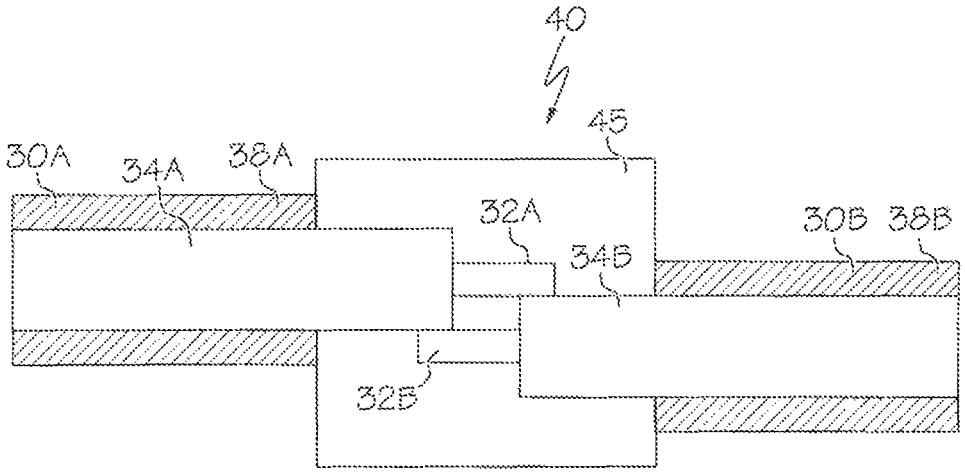
FIG. 6 is a simplified schematic circuit diagram illustrating cross-connected coaxial cables according to some embodiments.

FIG. 6 is a simplified schematic diagram illustrating a technique for implementing the crossover connection 40 of FIG. 5 according to some embodiments. In some embodiments, the crossover connection 40 includes a housing 45 into which the first and second coaxial cables 30A, 30B are inserted. The housing 45 may provide structural support for the crossover connection 40 and may also provide environmental protection for exposed portions of the coaxial cables 30A, 30B within the housing 45.

The outer insulating jackets 38A, 38B of the first and second coaxial cables 30A, 308 may be stripped from at least a portion of the coaxial cables 30A, 30B so that at least portions of the outer conductors 34A, 34B of the coaxial cables 30A, 308 are exposed within the housing 45. The first and second coaxial cables 30A, 30B are connected such that the inner conductor 32A of the first coaxial cable 30A directly contacts the exposed outer conductor 34B of the second coaxial cable 308, and the inner conductor 32B of the second coaxial cable 30B directly contacts the exposed outer conductor 34A of the first coaxial cable 30A.

Figure 7:
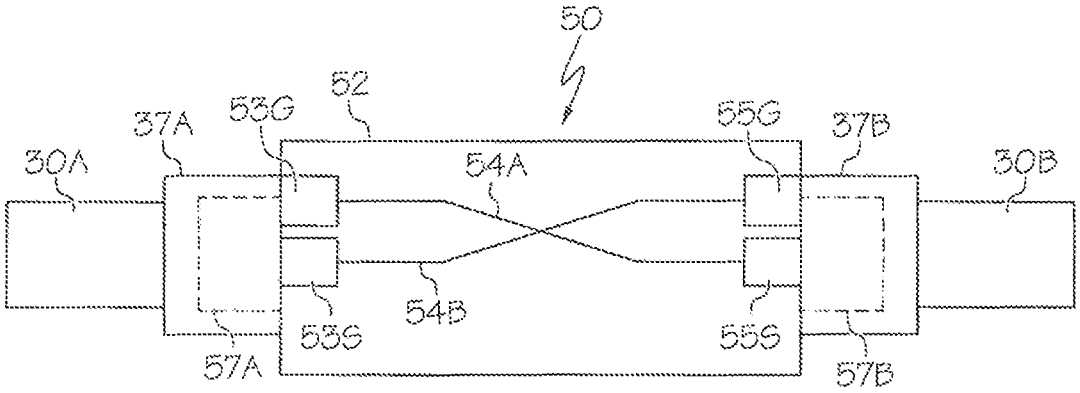
FIG. 7 is a simplified schematic circuit diagram illustrating a connector for cross-connecting coaxial cables according to some embodiments.

FIG. 7 is a simplified schematic diagram of a crossover connector 50 that may be used to join two coaxial cables 30A, 30H in a crossover connection. In FIG. 7, each of the coaxial cables 30A, 30B is terminated by a respective female coaxial connector 37A, 37B. Coaxial connectors are commonly used for connecting coaxial cables to ports on various types of equipment.

The crossover connector 50 includes a housing 52 and a pair of male coaxial connectors 57A, 57B that matingly connect with the female coaxial connectors 37A, 37B of the coaxial cables 30A, 308 to form respective connector pairs 37A/57A and 37B/57B. Each of the male coaxial connectors 57A, 57B includes inner and outer conductors that conductively connect to the respective inner and outer conductors of the coaxial cables 30A, 30B through the female coaxial connectors 37A, 37B. The outer conductor 34A of the first coaxial cable 30A is connected through the first connector pair 37A/57A to a first ground connector 53G in the housing 52, and the inner conductor 32A of the first coaxial cable 30A is connected through the first connector pair 37A/57A to a first signal connector 53S in the housing 52. Likewise, the outer conductor 34B of the second coaxial cable 30B is connected through the second connector pair 37B/57B to a second ground connector 55G in the housing 52, and the inner conductor 32B of the second coaxial cable 308 is connected through the second connector pair 37B/57B to a second signal connector 55S in the housing 52.

Within the housing 52, the first ground connector 53G is conductively connected to the second signal connector 55S via a conductor 54A, and the first signal connector 53S is conductively connected to the second ground connector 55G via a conductor 54B. The conductors 54A, 54B, which are illustrated schematically in FIG. 7, may include, for example, wires, conductive traces on a printed circuit board, etc. In this manner, the crossover connector 50 conductively connects the inner conductor 32A of the first coaxial cable 30A to the outer conductor 34B of the second coaxial cable 308, and vice-versa.

Figure 8:
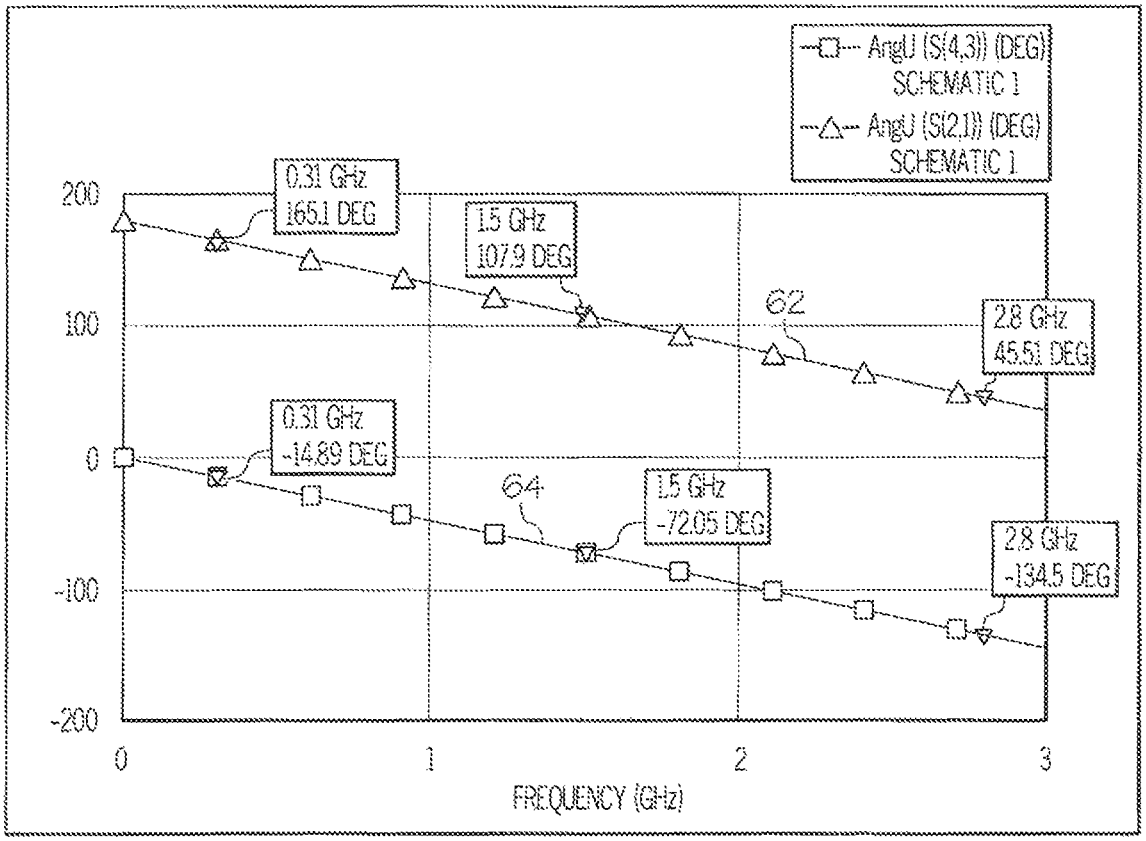
FIG. 8 is a graph of phase as a function of frequency for signals traveling on an inner conductor and an outer conductor of a coaxial cable.

FIG. 8 is a graph of phase as a function of frequency for signals traveling on an inner conductor, curve 62, and an outer conductor, curve 64, of a coaxial cable. The phase difference between the signals is very constant, with a degree of unbalance of only ±0.01 degrees, illustrating that the phase difference between signals carried on the inner and outer conductors of a coaxial cable is substantially independent of frequency.

Figure 9:
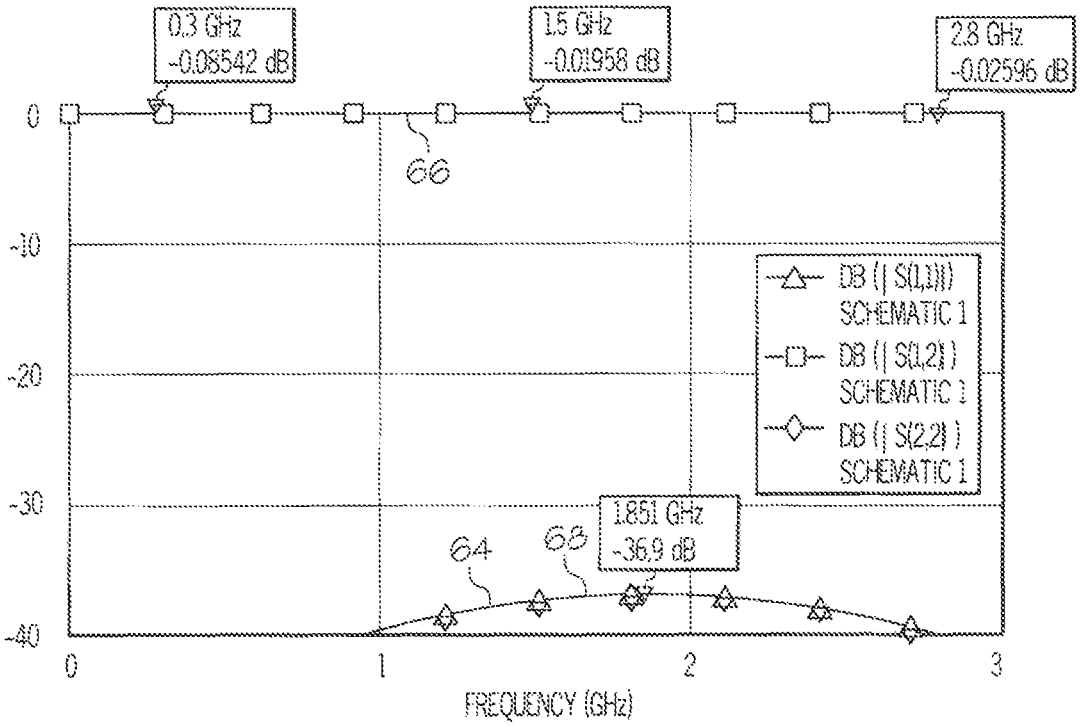
FIG. 9 is a graph of S-parameters of a cross-coupled coaxial cable according to some embodiments.

FIG. 9 is a graph of the input port reflection coeffiecient (S1,1) (curve 64), the reverse voltage gain S(1,2) (curve 66), and the output port reflection coefficient S(2,2) (curve 68) of a cross-coupled coaxial cable according to some embodiments. As shown in FIG. 9, the return loss and insertion loss of the cable are the same as a conventional (i.e. non cross-connected) coaxial cable. Thus, the reflection coefficients are very low (<–30 dB), while the reverse voltage gain is near unity (0 dB).

Embodiments of the inventive concepts can be employed to improve the cross polarization ratio of a dipole antenna or to improve isolation in a patch dipole antenna.

Figure 10:
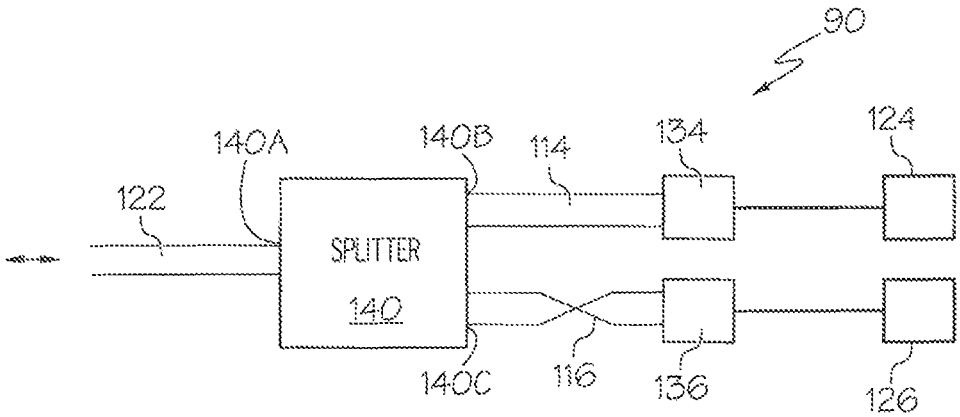
FIG. 10 is a simplified schematic diagram illustrating the use of a cross-connected transmission line to feed a radiating probe of a dipole antenna in accordance with some embodiments.

FIG. 10 is a simplified schematic diagram illustrating the use of a cross-connected transmission line to feed a feed probe or dipole of an antenna 90 in accordance with some embodiments. As shown therein, a feed line 122 is provided to a splitter 140 including an input port 140A and a pair of output ports 1408, 140C. The splitter 140 splits the input signal received at the input port 140A and feeds the split signal to a first (conventional) transmission line 114 and a second, cross-connected, transmission line 116 connected to the output ports 1408, 140C. The cross-connected transmission line 116 may include first and second cross-connected coaxial cables as illustrated, for example, in FIGS. 5 to 7, although other types of transmission lines, such as microstrip transmission lines, may be used. The first transmission line 114 is coupled to a feed point 134 of a first feed probe or dipole 124 of an antenna 90, while the second transmission line 116 is coupled to a feed point 136 of a second feed probe or dipole 126 of the antenna. The first and second transmission lines 114,116 have the same electrical length. The first and second probes or dipoles 124,126 of the antenna are thereby fed by anti-phase signals (i.e., signals that are 180 degrees out of phase with each other).

Figure 11:
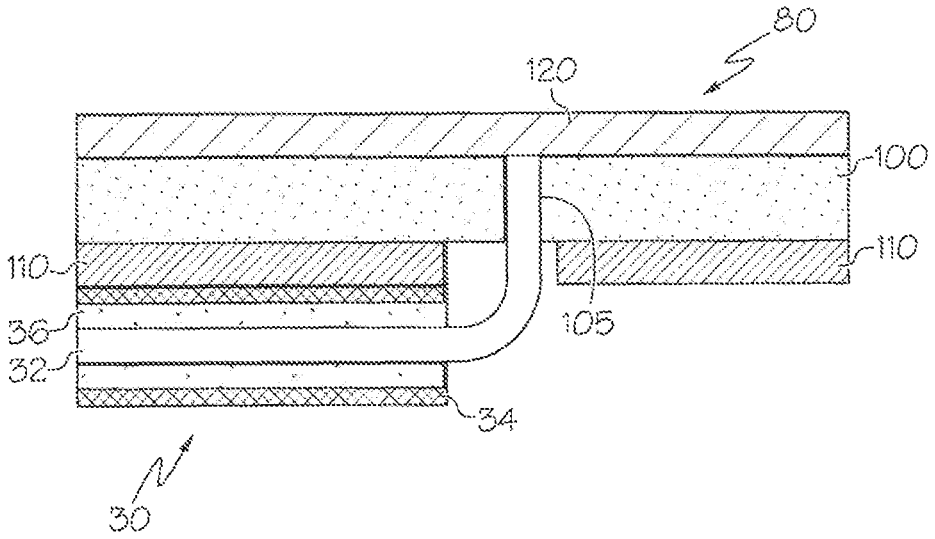
FIG. 11 is a simplified schematic diagram illustrating a conventional connection between a coaxial transmission line and a microstrip transmission line.

FIG. 11 is a simplified schematic diagram illustrating a conventional connection between a coaxial transmission line 30 and a microstrip transmission line 80. The microstrip transmission line 80 is formed on a substrate 100, which may, for example, be formed of a dielectric material. For example, the substrate 100 may include an FR-4 printed circuit board, or a material such as alumina, tetrafinctional epoxy, polyphenylene ether, epoxy/polyphenylene oxide, bismaleimide triazine (BT), thermount, cyanate ester, polyimide, or liquid crystal polymer.

The microstrip transmission line 80 includes a microstrip conductor 120 formed on a first side of the substrate 100 and a ground plane 110 formed on the opposite side of the substrate 100. The ground plane 110 and microstrip conductor 120 are typically provided as conductive traces formed of a conductive metal such as copper that is deposited on the substrate 100 and patterned using etch techniques.

In the conventional connection between a coaxial cable 30 and a microstrip transmission line 80 shown in FIG. 11, the outer conductor 34 of the coaxial cable 30 is brought into contact with the ground plane 110 so that it is conductively coupled to the ground plane 110, and the inner conductor 32 of the coaxial cable 30 extends through a via 105 in the substrate 100 to conductively contact the microstrip conductor 120 so that it is conductively coupled to the microstrip conductor 120. In this manner, the signal carried by the inner conductor 32 is coupled directly to the microstrip conductor 120, while the grounded outer conductor 34 is coupled directly to the ground plane 110 of the microstrip transmission line 80.

Figure 12:
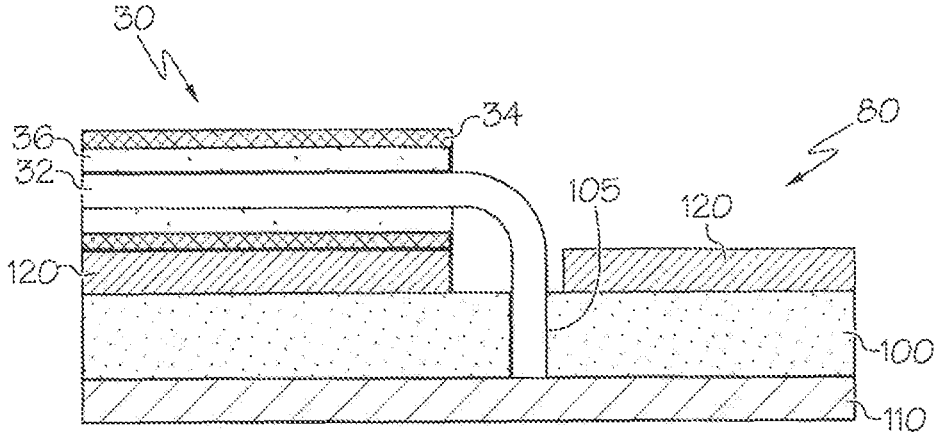
FIG. 12 is a simplified schematic diagram illustrating a crossover connection between a coaxial transmission line and a microstrip transmission line according to some embodiments.

FIG. 12 is a simplified schematic diagram illustrating a crossover connection between a coaxial transmission line 30 and a microstrip transmission line 80 according to some embodiments. In the crossover connection between a coaxial cable 30 and a microstrip transmission line 80 shown in FIG. 12, the outer conductor 34 of the coaxial cable 30 is brought into contact with the microstrip conductor 120, and the inner conductor 32 of the coaxial cable 30 extends through a via 105 in the substrate 100 to conductively contact the ground plane 110. In this manner, the signal carried by the inner conductor 32 is coupled directly to the ground plane 110, while the grounded outer conductor 34 is coupled directly to the microstrip conductor 120. A coaxial cable can supply a 180 degree phase shifted signal to a microstrip transmission line using the crossover connection illustrated in FIG. 12.

In some embodiments, a crossover transmission line includes cross-connected microstrip transmission lines. For example, FIG. 13 is a simplified isometric diagram illustrating a crossover connection between microstrip transmission lines according to some embodiments.

Figure 13:
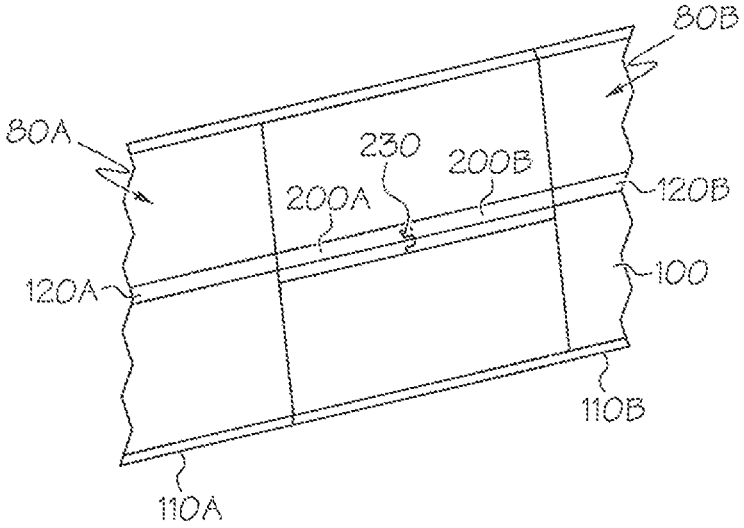
FIG. 13 is a simplified isometric diagram illustrating a crossover connection between microstrip transmission lines according to some embodiments.

In particular, FIG. 13 illustrates a first microstrip transmission line 80A including a first microstrip conductor 120A and a first ground plane 110A and a second microstrip transmission line 80B including a second microstrip conductor 120B and a second ground plane 110B. The first microstrip conductor 120A is coupled to the second ground plane 110B and the second microstrip conductor 120B is coupled to the first ground plane 110A via a crossover connection. The connection between the microstrip conductors and ground planes of the first and second microstrip transmission lines 80A, 80B may be accomplished through a balanced line crossover connection. That is, the first microstrip transmission line 80A may be coupled to a first balanced line 200A, and the second microstrip transmission line 80B may be coupled to a second balanced line 200B. The first and second balanced lines 200A, 2008 are cross-connected to couple the first microstrip conductor 120A to the second ground plane 110B and the second microstrip conductor 120B to the first ground plane 110A.

Figure 14:
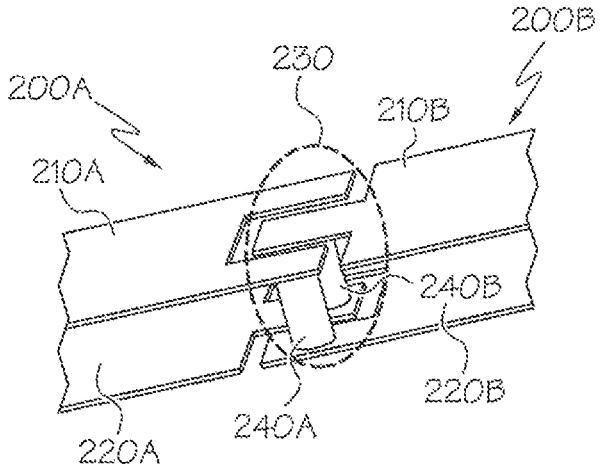
FIG. 14 is a simplified isometric diagram illustrating a crossover connection between balanced transmission lines according to some embodiments.

As is known in the art, a balanced line or balanced signal pair is a transmission line including two conductors of the same type, each of which have equal impedances along their lengths and equal impedances to ground and to other circuits. FIG. 14 is a simplified isometric diagram illustrating a crossover connection between balanced transmission lines 200A, 200B according to some embodiments. In particular, the first balanced transmission line 200A includes a first conductor 210A and a second conductor 220A having equal widths in a direction transverse to the direction of signal propagation, and the second balanced transmission line 2008 includes a first conductor 210B and a second conductor 220B, also having equal widths. The first conductors 210A, 2108 may be formed on the first surface of the same substrate 100 on which the microstrip conductors 120A, 120B are formed, and the second conductors 220A, 220B may be formed on the second surface of the substrate 100 on which the ground planes 110A, 110B are formed.

The first conductor 210A of the first balanced transmission line 200A is coupled to the first microstrip conductor 120A of the first microstrip transmission line 80A (FIG. 13). The second conductor 220A of the first balanced transmission line 200B is coupled to the first ground plane 110A of the first microstrip transmission line 80A (FIG. 13). The second conductor 220A of the first balanced transmission line 200A has a width transverse to the direction of signal flow that is less than the corresponding width of the first ground plane 110A to which it is connected.

Likewise, the first conductor 210B of the second balanced transmission line is coupled to the first microstrip conductor 120B of the second microstrip transmission line 80B, and the second conductor 220B of the second balanced transmission line is coupled to the second ground plane 110B of the second microstrip transmission line 80B (FIG. 13). The second conductor 220B of the second balanced transmission line 2008 has a width transverse to the direction of signal flow that is less than the corresponding width of the second ground plane 110B to which it is connected.

Figure 15A:
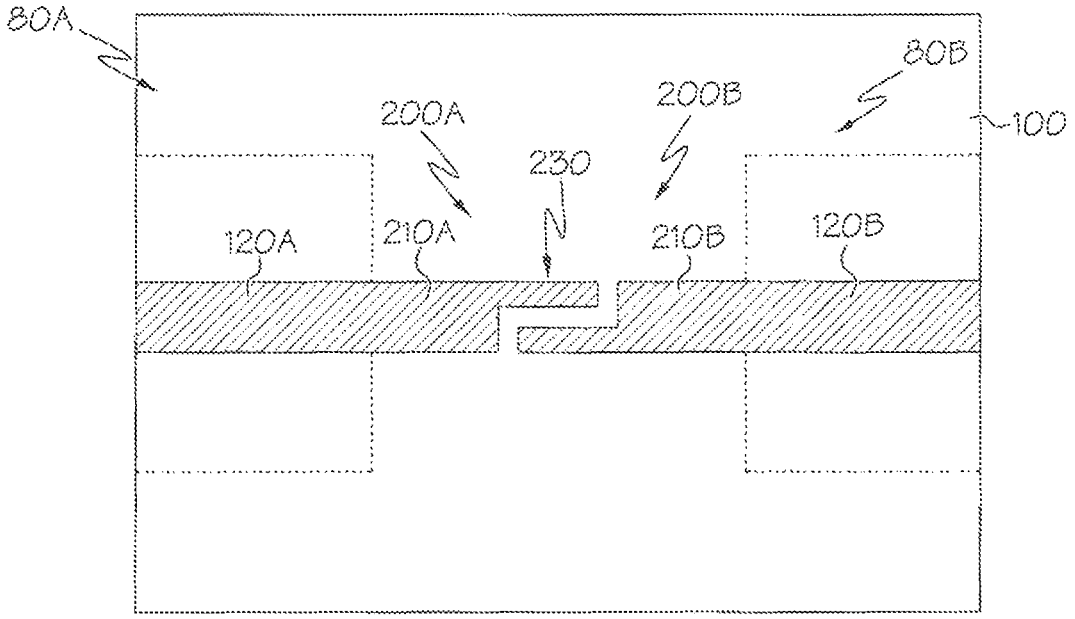
FIGS. 15A and 15B are top and bottom views illustrating a crossover connection between microstrip transmission lines according to some embodiments.
Figure 15B:
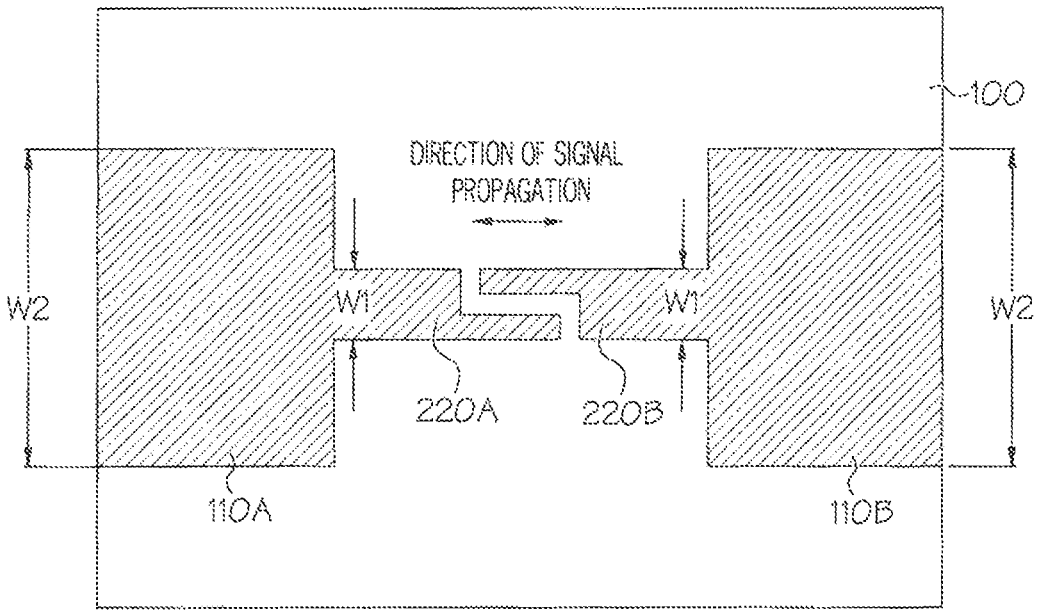
Figure 16A:
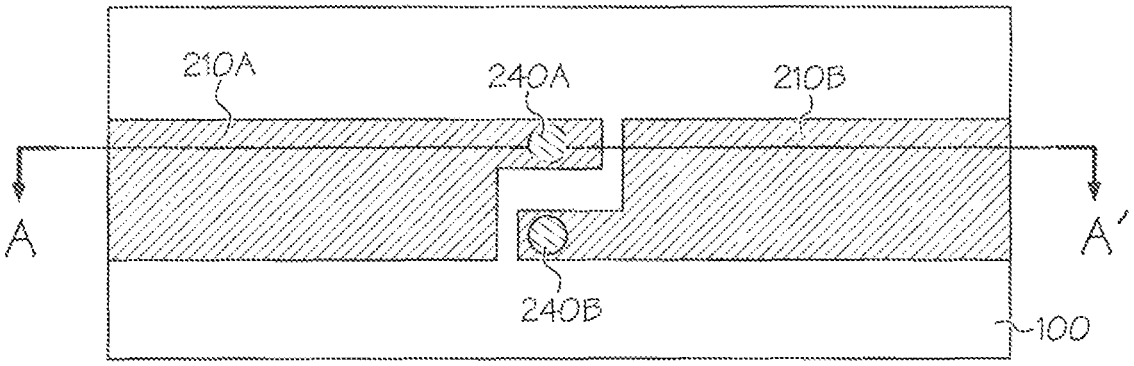
FIG. 16A is a top view illustrating a crossover connection between balanced transmission lines according to some embodiments.
Figure 16B:
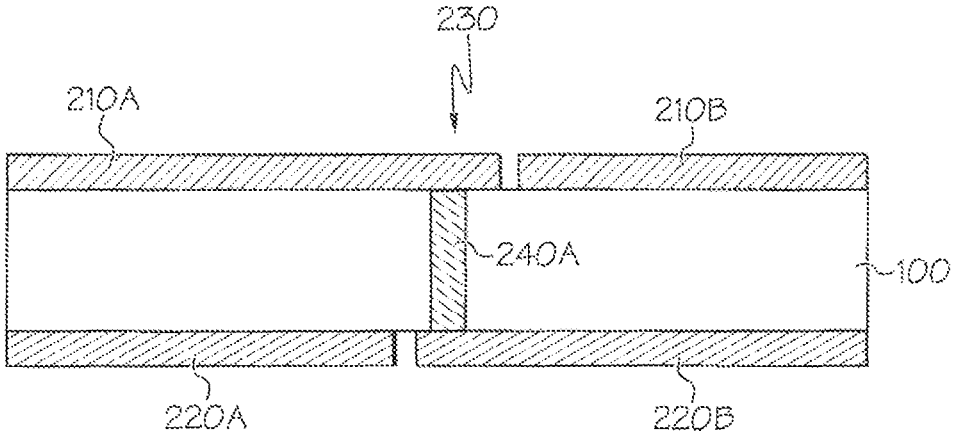
FIG. 16B is a cross sectional illustration taken along line A-A' of FIG. 16A.

The first and second balanced transmission are cross-connected via a crossover connection 230. FIGS. 15A and 15B are top and bottom views, respectively, of a crossover connection 230 between microstrip transmission lines 80A, 80B formed on a substrate 100 according to some embodiments. FIG. 16A is a simplified schematic diagram illustrating a crossover connection between balanced transmission lines according to some embodiments, and FIG. 16B is a cross sectional illustration taken along line A-A' of FIG. 16A.

Referring to FIGS. 15A, 15B, 16A and 16B, the first balanced transmission line 200A includes a first conductor 210A and a second conductor 220A having equal widths, and the second balanced transmission line 2008 includes a first conductor 210B and a second conductor 220B, also having equal widths. The first conductors 210A, 210B may be formed on the first surface of the same substrate 100 on which the microstrip conductors 120A. 120B are formed, and the second conductors 220A, 220B may be formed on the second surface of the substrate 100 on which the ground planes 110A, 110B are formed.

The first conductor 210A of the first balanced transmission line 200A is coupled to the first microstrip conductor 120A of the first microstrip transmission line 80A. The first conductor 210A of the first balanced transmission line 200A may have the same width as the first microstrip conductor 120A of the first microstrip transmission line 80A to which it is connected. The second conductor 220A of the first balanced transmission line 200B is coupled to the first ground plane 110A of the first microstrip transmission line 80A. Referring to FIG. 15B, the second conductor 220A of the first balanced transmission line 200A has a width w1 transverse to the direction of signal flow that is less than the corresponding width w2 of the first ground plane 110A to which it is connected.

Likewise, the first conductor 2108 of the second balanced transmission line is coupled to the first microstrip conductor 120B of the second microstrip transmission line 80B, and the second conductor 220B of the second balanced transmission line is coupled to the second ground plane 110B of the second microstrip transmission line BOB. The first conductor 210B of the second balanced transmission line may have the same width as the first microstrip conductor 120B of the second microstrip transmission line 80B to which it is connected. The second conductor 220 of the second balanced transmission line 200B has a width w1 transverse to the direction of signal flow that is less than the corresponding width w2 of the second ground plane 110B to which it is connected.

To form the crossover connection 230, the first and second balanced transmission lines 200A, 200B are interdigitated and connected using conductive plugs that extend through the substrate 100. In particular, the ends of the first and second balanced transmission lines 200A, 200B are arranged so that a portion of the first conductor 210A of the first balanced transmission line 200A extends over a portion of the second conductor 220B of the second balanced transmission line 2008, and vice versa. First and second conductive plugs 240A, 240B are formed to extend through the substrate 100. The first conductive plug 240A couples the first conductor 210A of the first balanced transmission line 200A to the second conductor 220B of the second balanced transmission line 200B, and the second conductive plug 2408 couples the second conductor 220A of the first balanced transmission line 200A to the first conductor 210B of the second balanced transmission line 200B.

The ends of the first and second balanced transmission lines 200A, 200 may be interdigitated such that one or two (or more) interlocking digits are formed at the ends of the lines as illustrated in FIG. 14, or only a single interlocking digit is formed at the ends of the lines as illustrated in FIGS. 15A, 158, 16A and 168. Any number of digits may be provided, and the inventive concepts are not limited to the particular configurations illustrated. Moreover, connections between the conductors of the first and second balanced transmission lines of the may be formed in ways other than by using conductive plugs. For example, interlayer metallization in the substrate may be used to connect the conductors, and the inventive concepts are not limited to the particular configurations illustrated.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

In the specification, there have been disclosed embodiments of the invention and, although specific terms are employed, they are used in a generic and descriptive sense only and not for purposes of limitation. The following claim is provided to ensure that the present application meets all statutory requirements as a priority application in all jurisdictions and shall not be construed as setting forth the scope of the present invention.

The invention claimed is:

1. A crossover transmission line comprising:

an input port;

an output port;

a first transmission line including a first signal conductor and a first ground conductor; and a second transmission line including a second signal conductor and a second ground conductor, wherein the first signal conductor is coupled to the input port and to the second ground conductor and the second signal conductor is coupled to the output port and the first ground conductor, wherein the first transmission line comprises a first coaxial cable including a first inner conductor corresponding to the first signal conductor and a first outer conductor corresponding to the first ground conductor, wherein the second transmission line comprises a microstrip transmission line including a microstrip conductor corresponding to the second signal conductor and a ground plane corresponding to the second ground conductor, wherein the first inner conductor is electrically coupled to the ground plane, and wherein the first outer conductor is electrically coupled to the microstrip conductor.

2. The crossover transmission line of claim 1, wherein:

the second transmission line comprises a second coaxial cable including a second inner conductor corresponding to the second signal conductor and a second outer conductor corresponding to the second ground conductor;

the first inner conductor is electrically coupled to the second outer conductor; and the first outer conductor is electrically coupled to the second inner conductor.

3. The crossover transmission line of claim 1, wherein the first transmission line comprises a first microstrip transmission line including a first microstrip conductor corresponding to the first signal conductor and a first ground plane corresponding to the first ground conductor and the second transmission line comprises a second microstrip transmission line including a second microstrip conductor corresponding to the second signal conductor and a second ground plane corresponding to the second ground conductor;

wherein the crossover transmission line further comprises:

a first balanced transmission line coupled to the first transmission line, the first balanced transmission line including a first signal line and a first ground line;

a second balanced transmission line coupled to the second transmission line, the second balanced transmission line including a second signal line and a second ground line; and a crossover connection between the first balanced transmission line and the second balanced transmission line, wherein the first signal line is electrically coupled to the second ground line and the first ground line is electrically coupled to the second signal line.

4. The crossover transmission line of claim 3, further comprising a substrate, wherein:

the first signal line comprises a first conductive trace on a first surface of the substrate;

the first ground line comprises a second conductive trace on a second surface of the substrate opposite the first signal line; and the first signal line and the first ground line have the same width.

5. The crossover transmission line of claim 4, wherein:

the second signal line comprises a third conductive trace on the first surface of the substrate;

the second ground line comprises a fourth conductive trace on the second surface of the substrate opposite the first signal line; and the second signal line and the second ground line have the same width.

6. The crossover transmission line of claim 5, further comprising:

a first conductive plug extending through the substrate and electrically coupling the first signal line and the second ground line; and a second conductive plug extending through the substrate and electrically coupling the second signal line and the first ground line.

7. The crossover transmission line of claim 6, wherein the first ground plane is wider in a direction transverse to a direction of signal propagation through the first transmission line than the first ground line; and the second ground plane is wider in the direction transverse to current flow through the first transmission line than the second ground line.

8. The crossover transmission line of claim 6 in combination with:

a feed line;

a splitter including an input port and first and second output ports, wherein the feed line is connected to the input port of the splitter and a first end of the crossover transmission line is connected to the first output port of the splitter; and a first radiating element coupled to a second end of the crossover transmission line.

9. The crossover transmission line of claim 8, further in combination with:

a second radiating element; and a non-crossover transmission line having a first end that is connected to the second output port of the splitter and a second end that is connected to the second radiating element.

10. The crossover transmission line of claim 9, wherein the first and second radiating elements comprise respective first and second microstrip probes.

11. A crossover transmission line comprising:

a first transmission line including a first signal conductor and a first ground conductor;

a second transmission line including a second signal conductor and a second ground conductor, wherein the second transmission line comprises a microstrip transmission line including a microstrip conductor corresponding to the second signal conductor and a ground plane corresponding to the second ground conductor; and a crossover coupler connected between the first and second transmission lines, wherein the crossover coupler is configured to electrically couple the first signal conductor to the ground plane and to electrically couple the microstrip conductor to the first ground conductor.

12. A crossover transmission line comprising:

an input port;

an output port;

a first microstrip transmission line including a first microstrip conductor coupled to the input port and a first ground plane;

a second microstrip transmission line comprising a second microstrip conductor coupled to the output port and a second ground plane; and a crossover coupler connected between the first microstrip transmission line and the second microstrip transmission line, wherein the crossover coupler is configured to electrically couple the first microstrip conductor to the second ground plane and to electrically couple the second microstrip conductor to the first ground plane.

13. The crossover transmission line of claim 12, wherein the crossover coupler is configured to provide a signal at the second microstrip conductor that is approximately 180 degrees out of phase with a signal at the first microstrip conductor over an operational bandwidth.

* * * * *